US012059024B2

(12) United States Patent
Joyeux et al.

(10) Patent No.: US 12,059,024 B2
(45) Date of Patent: Aug. 13, 2024

(54) AEROSOL-GENERATING ARTICLE HAVING BIODEGRADABLE FILTRATION MATERIAL

(71) Applicant: PHILIP MORRIS PRODUCTS S.A., Neuchatel (CH)

(72) Inventors: Thierry Joyeux, Morges (CH); Ping Li, Lausanne (CH); Stefanos Papakyrillou, Cortaillod (CH)

(73) Assignee: Philip Morris Products S.A., Neuchatel (CH)

( * ) Notice: Subject to any disclaimer, the term of this patent is extended or adjusted under 35 U.S.C. 154(b) by 666 days.

(21) Appl. No.: 17/298,097

(22) PCT Filed: Dec. 5, 2019

(86) PCT No.: PCT/EP2019/083839
§ 371 (c)(1),
(2) Date: May 28, 2021

(87) PCT Pub. No.: WO2020/115219
PCT Pub. Date: Jun. 11, 2020

(65) Prior Publication Data

US 2022/0022526 A1 Jan. 27, 2022

(30) Foreign Application Priority Data

Dec. 7, 2018 (EP) ..... 18211158

(51) Int. Cl.
*A24D 3/06* (2006.01)
*A24D 1/04* (2006.01)
(Continued)

(52) U.S. Cl.
CPC ..... *A24D 1/045* (2013.01); *A24D 1/20* (2020.01); *A24D 3/063* (2013.01); *A24D 3/068* (2013.01); *A24D 3/10* (2013.01)

(58) Field of Classification Search
CPC ..... A24D 1/045; A24D 1/20; A24D 3/063; A24D 3/068; A24D 3/10; A24D 3/08
See application file for complete search history.

(56) References Cited

U.S. PATENT DOCUMENTS 4,182,350 A * 1/1980 Steinau ..... A24D 3/08 131/332
5,732,718 A * 3/1998 Douglas ..... D01F 2/00 131/342
(Continued)

FOREIGN PATENT DOCUMENTS

EP 0 434 339 6/1991
EP 0822670 2/1998
(Continued)

OTHER PUBLICATIONS

Extended European Search Report for Application No. 18211158.3 dated Apr. 17, 2019 (7 pages).
(Continued)

*Primary Examiner* — Abdullah A Riyami
*Assistant Examiner* — Nelson R. Burgos-Guntin
(74) *Attorney, Agent, or Firm* — Mueting Raasch Group

(57) ABSTRACT

There is provided an aerosol-generating article (10) comprising an aerosol-generating substrate (12) and a filter (14) in axial alignment with the aerosol-generating substrate (12). The filter (14) comprises at least one segment of filtration material formed of one or more sheets of a fibrous paper-like material. The fibrous paper-like material comprises a combination of hydrophobic fibres and hydrophilic fibres such that the fibrous paper-like material has a water contact angle as measured in accordance with TAPPI/ANSI T 558 om-15 greater than 90 degrees. Further, the fibrous paper material has a biodegradability in aqueous medium as tested in accordance with ISO 14851 (2005) of at least 90 percent of the maximum degradation of a cellulose reference
(Continued)

Figure 1:
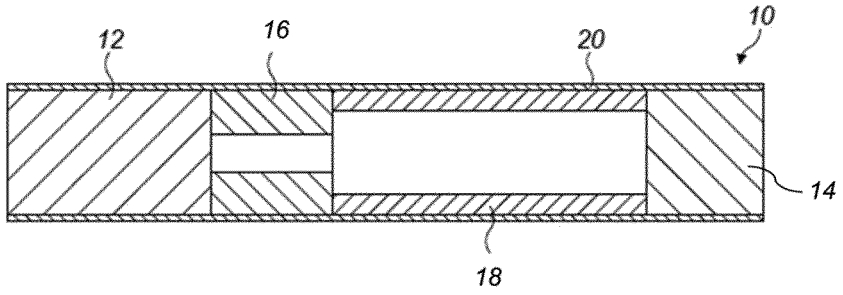

item within 56 days of testing. In addition, the hydrophobic fibres comprise hydrophobic viscose fibres.

13 Claims, 1 Drawing Sheet

(51) Int. Cl.
*A24D 1/20* (2020.01)
*A24D 3/10* (2006.01)

(56) References Cited

U.S. PATENT DOCUMENTS 6,273,762 B1 * 8/2001 Regnier ..... H01R 13/518 439/701
6,361,374 B1 * 3/2002 Lloyd ..... H01R 13/518 439/701
11,920,260 B2 * 3/2024 Hölter ..... C08J 3/212
2005/0133048 A1 * 6/2005 Fournier ..... A24D 3/14 131/202
2008/0295852 A1 12/2008 Riepert
2011/0036366 A1 * 2/2011 Sebastian ..... A24D 3/08 131/342
2012/0003848 A1 * 1/2012 Casher ..... H05K 1/0222 174/262
2012/0034820 A1 * 2/2012 Lang ..... H01R 12/716 439/660
2012/0160254 A1 * 6/2012 Kumar ..... A24D 3/08 131/331
2013/0014774 A1 * 1/2013 Sebastian ..... A24D 3/068 428/394
2014/0096783 A1 * 4/2014 Sebastian ..... A24D 3/068 264/103
2015/0329707 A1 11/2015 Roggenstein
2017/0354179 A1 12/2017 Sebastian
2020/0083627 A1 * 3/2020 Peloza ..... H01R 13/6587
2021/0075143 A1 * 3/2021 Laurx ..... H01R 43/205
2021/0126404 A1 * 4/2021 Laurx ..... H01R 13/629
2021/0328384 A1 * 10/2021 Avery ..... H01R 13/6583
2021/0395465 A1 * 12/2021 Kelly ..... B01D 39/1669
2022/0022526 A1 * 1/2022 Joyeux ..... A24D 3/063
2022/0167659 A1 * 6/2022 Sebold ..... A24B 15/12
2022/0175021 A1 * 6/2022 Austin ..... A24D 1/02
2022/0192254 A1 * 6/2022 Dubey ..... A24D 1/045
2022/0368077 A1 * 11/2022 Little ..... H01R 4/023
2023/0011768 A1 * 1/2023 Dimmick ..... A24C 5/01
2023/0014802 A1 * 1/2023 Hepworth ..... A24F 40/30
2023/0017594 A1 * 1/2023 Hepworth ..... A24D 1/20
2023/0309610 A1 * 10/2023 Abi Aoun ..... A24D 1/18 131/347
2024/0049766 A1 * 2/2024 Koide ..... A24B 3/14

FOREIGN PATENT DOCUMENTS

EP 3209149 2/2020
WO WO 2006/108470 10/2006
WO WO 2009/022232 2/2009
WO WO 2011/101164 8/2011
WO WO 2012/164009 12/2012
WO WO 2013/124475 8/2013
WO WO 2016/108119 7/2016
WO WO 2018/122115 7/2018

OTHER PUBLICATIONS

PCT Search Report and Written Opinion for PCT/EP2019/083839 dated Mar. 16, 2020 (9 pages).

* cited by examiner

AEROSOL-GENERATING ARTICLE HAVING BIODEGRADABLE FILTRATION MATERIAL

This application is a U.S. National Stage Application of International Application No. PCT/EP2019/083839 filed Dec. 5, 2019, which was published in English on Jun. 11, 2020 as International Publication No. WO 2020/115219 A1. International Application No. PCT/EP2019/083839 claims priority to European Application No. 18211158.3 filed Dec. 7, 2018.

The present invention relates to an aerosol-generating article comprising a filter with at least one segment formed of a biodegradable filtration material.

Conventional aerosol-generating articles, such as filter cigarettes, typically comprise a cylindrical rod of tobacco cut filler surrounded by a paper wrapper and a cylindrical filter axially aligned, most often in an abutting end-to-end relationship, with the wrapped tobacco rod. The cylindrical filter typically comprises one or more plugs of a fibrous filtration material, such as cellulose acetate tow, circumscribed by a paper plug wrap. Conventionally, the wrapped tobacco rod and the filter are joined by a band of tipping wrapper, normally formed of an opaque paper material that circumscribes the entire length of the filter and an adjacent portion of the wrapped tobacco rod.

A number of aerosol-generating articles in which tobacco is heated rather than combusted have also been proposed in the art. In heated aerosol-generating articles, an aerosol is generated by heating an aerosol-generating substrate, such as tobacco. Known heated aerosol-generating articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool they condense to form an aerosol that is inhaled by the consumer. Many known heated smoking articles comprise one or more plugs of a fibrous filtration material, such as cellulose acetate.

After an aerosol-generating article has been smoked and discarded, it is desirable for the filter section to break down as quickly as possible. Cellulose acetate, the most commonly used filtration material, is not biodegradable, and so a wide variety of dispersible and degradable materials have been proposed for use as filtration materials for aerosol-generating article.

However, in many cases, such alternative filtration materials have been found to be unable to provide an acceptable filtration efficiency and smoking experience for the consumer. Furthermore, in many cases dispersible and degradable materials have been found to be unsuitable for use in the existing manufacturing processes, and would require too significant a modification of the existing methods and equipment to make their use commercially feasible.

Thus, it would be desirable to provide an aerosol-generating article having a filter that is at least partially formed of a filtration material having an increased biodegradability, but which provides a filtration efficiency that is comparable to that of a cellulose acetate tow. Further, it would be desirable to provide such an aerosol-generating article that gives an acceptable sensory experience to the consumer. In addition, it would be desirable to provide such an aerosol-generating article that can be readily manufactured using existing high speed techniques and apparatus requiring only minimal modifications.

According to an aspect of the present invention, there is provided an aerosol-generating article comprising: an aerosol-generating substrate; a filter in axial alignment with the aerosol-generating substrate, the filter comprising at least one segment of filtration material formed of one or more sheets of a fibrous paper-like material, wherein the fibrous paper-like material comprises a combination of hydrophobic fibres and hydrophilic fibres such that the fibrous paper-like material has a water contact angle as measured in accordance with TAPPI/ANSI T 558 om-15 greater than 90 degrees and wherein the fibrous paper material has a biodegradability in aqueous medium as tested in accordance with ISO-14851 (2005) of at least 90 percent of the maximum degradation of a cellulose reference item within 56 days of testing.

According to a further aspect of the present invention, there is provided a filtration material for an aerosol-generating article, the filtration material comprising a sheet of fibrous paper-like material, wherein the fibrous paper-like material comprises a combination of hydrophobic fibres and hydrophilic fibres such that the fibrous paper-like material has a water contact angle as measured in accordance with TAPPI/ANSI T 558 om-15 greater than 90 degrees and wherein the fibrous paper material has a biodegradability in aqueous medium as tested in accordance with ISO-14851 (2005) of at least 90 percent of the maximum degradation of a cellulose reference item within 56 days of testing.

It will be appreciated that any features described with reference to one aspect of the present invention are equally applicable to any other aspect of the invention.

The term "aerosol generating article" is used herein to denote both articles wherein an aerosol generating substrate is heated and articles wherein an aerosol generating substrate is combusted, such as conventional cigarettes. As used herein, the term "aerosol generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke.

In heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention find particular application in aerosol generating systems comprising an electrically heated aerosol generating device having an internal heater blade which is adapted to be inserted into the rod of aerosol generating substrate. Aerosol generating articles of this type are described in the prior art, for example, in EP 0822670.

As used herein, the term "aerosol generating device" refers to a device comprising a heater element that interacts with the aerosol generating substrate of the aerosol generating article to generate an aerosol. Aerosol generating article according to the invention may comprise a combustible carbon heat source for heating the aerosol generating substrate during use. Aerosol generating articles of this type are described in the prior art, for example, in WO 2009/022232. Also known are aerosol generating articles in which a nicotine-containing aerosol is generated from a tobacco material, tobacco extract, or other nicotine source, without combustion, and in some cases without heating, for example through a chemical reaction. During smoking, volatile compounds are released from the aerosol forming substrate by heat transfer from the fuel element and entrained in air drawn through the aerosol generating article. As the released compounds cool they condense to form an aerosol that is inhaled by the consumer.

The term "paper-like" is used herein to denote a material in sheet form such as can be manufactured by methods and equipment known in the paper making art. In the manufacture of one such material, a fibrous starting material is typically homogenously distributed in an aqueous medium to obtain a dilute suspension. A dispersant may additionally be used with a view to assisting the distribution of the fibres in the aqueous suspension. By draining the suspension through a sieve-like screen, a mat of randomly interwoven fibres is laid down. Excess water is typically removed from such mat by pressing, optionally with the aid of suction or a source of heat. Following a drying step, a generally flat and uniform sheet is achieved.

As used in the present specification, the term "hydrophobic" refers to a material or surface exhibiting water repelling properties. As will be described in greater detailed below, one useful way to determine this is to measure the water contact angle. The "water contact angle" is the angle, conventionally measured through the liquid, where a liquid/vapour interface meets a solid surface. This angle substantially quantifies the wettability of a solid surface by a liquid as described by the Young equation.

By contrast, in the present specification the term "hydrophilic" is used to denote a material or surface exhibiting a strong affinity for water, for example a material or surface that exhibits a tendency to mix with, dissolve in or be wetted by water.

The term "hydrophobic fibres" is used to denote fibres having hydrophobic properties. In the case of fibres, hydrophobic properties may also be assessed by a sinking test. In one such test, the time required for a fibre to sink in a predetermined amount of water is measured. For a viscose fibre having no hydrophobic properties, the sinking time is typically less than 5 seconds. For a hydrophobic viscose fibre, the sinking time is typically greater than 24 hours. Hydrophobic viscose fibres are described, for example, in US 2015/0329707. In more detail, US 2015/0329707 discloses a hydrophobic viscose fibre as being typically a resulting mixture of a viscose fibre and a hydrophobic substance selected from the group consisting of alkyl ketene dimers, alkenyl ketene dimers, alkyl succinic anhydrides, alkenyl succinic anhydrides, alkyl glutaric acid anhydrides, alkenyl glutaric acid anhydrides, alkyl isocyanates, alkenyl isocyanates, fatty acid anhydrides, and mixtures thereof. The content of hydrophobic substance is from about 0.1 percent by weight based on viscose fibre to about 13 percent by weight based on viscose fibre, and preferably from about 1 percent by weight based on viscose fibre to about 7.5 percent by weight based on viscose fibre. An example of a suitable hydrophobic viscose fibre is the OLEA® viscose fibre by Kelheim Fibres GmbH.

The term "cellulose fibres" is used herein to identify bleached or unbleached cellulosic plant fibres obtained by a chemical, mechanical or thermomechanical pulping process, such as softwood fibres, wood pulp or the pulp of annual plants such as, for example, flax or tobacco. Further, the term "cellulose fibre" may refer to a mixture of two or more of these bleached or unbleached cellulosic plant fibres.

As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis.

Any reference to the "cross-section" of the aerosol-generating article or a component of the aerosol-generating article refers to the transverse cross-section unless stated otherwise. As used herein, the term "length" refers to the dimension of a component in the longitudinal direction and the term "width" refers to the dimension of a component in the transverse direction. The term "maximum width" refers to the maximum cross-sectional dimension of a component. For example, in the case of a segment having a circular cross-section, the maximum width correspond to the diameter of the circle.

When used in relation to a strand or strip cut or shredded from a sheet material, the term "width" refers to the smaller dimension of the strand or strip when it is laid flat, irrespective of the spatial orientation of the strand or strip within the aerosol-generating article. The term "length", when used in relation to a strand or strip formed from the sheet material, refers to the larger dimension of the strand or strip when it is laid flat, irrespective of the spatial orientation of the strand or strip within the aerosol-generating article.

As used herein, the terms "upstream" and "downstream" describe the relative positions of segments or elements, or portions of segments or elements, of the aerosol-generating article in relation to the direction in which the aerosol is transported through the aerosol-generating article during use.

An aerosol-generating article in accordance with the present invention comprises an aerosol-generating substrate and a filter in axial alignment with the aerosol-generating substrate. The filter is typically arranged downstream from the aerosol-generating substrate. The filter comprises at least one segment of filtration material formed of one or more sheets of a fibrous paper-like material.

In contrast to existing aerosol-generating articles, in accordance with the present invention the fibrous paper-like material comprises a combination of hydrophobic fibres and hydrophilic fibres such that the fibrous paper-like material has a water contact angle as measured in accordance with TAPPI/ANSI T 558 om-15 greater than 90 degrees. In practice, the ratio of hydrophobic fibres and hydrophilic fibres in the fibrous paper-like material is advantageously balanced so that a sheet of the fibrous paper-like material behaves as an overall hydrophobic material, whilst at the same time retaining a sufficient amount of hydrophilic fibres to make it possible to form the sheet in a paper-making process.

Further, the fibrous paper-like material has a biodegradability in aqueous medium as tested in accordance with ISO-14851 (2005) of at least 90 percent of the maximum degradation of a cellulose reference item within 56 days of testing. By using biodegradable fibres for both the hydrophobic and the hydrophilic elements of the fibrous paper-like material, a high level of biodegradability can advantageously be achieved.

In practice, the filter segment of aerosol-generating articles in accordance with the present invention provides a similar balance of hydrophobicity and hydrophilicity as is found with a conventional cellulose acetate filter segment, but with the advantage of a significantly increased biodegradability. The inclusion of the hydrophilic fibres enables a paper-like web material to be formed using techniques traditionally employed for paper-making, whilst at the same time the addition of hydrophobic fibres leads to the provision of an overall hydrophobic sheet, such that ultimately properties similar to those of conventional (non-biodegradable) cellulose acetate materials are obtained. The presence of hydrophobic and hydrophilic fibres in the material can be determined by paper micrographic analysis well known in the art. In a sheet of fibrous paper-like material, the hydrophilic fibres and the hydrophobic fibres represent at least 50 percent, at least 60 percent, at least 70 percent, or at least 80 percent of weight of the dry matter of the fibrous paper-like material.

Thus, the overall sensory experience provided by the filter segments of aerosol-generating articles in accordance with the present invention is effectively comparable with that of a conventional cellulose acetate tow filter segment, but with a significantly improved environmental impact.

Manufacture of aerosol-generating articles in accordance with the present invention does not require any significant modification of the existing equipment and processes. Sheet material can be readily manufactured using conventional paper making techniques and can be formed into filter rods using existing filter making apparatus, which makes the use of the material commercially viable. An inclined wire process is particularly preferred for forming the sheet, since it facilitates formation of a highly porous and bulky web structure.

As described briefly above, in an aerosol-generating substrate in accordance with the present invention, the filter comprises at least one segment of filtration material formed of one or more sheets of a fibrous paper-like material, wherein the fibrous paper-like material comprises a combination of hydrophobic fibres and hydrophilic fibres. By adjusting the type and amount of hydrophobic fibres incorporated into the fibrous paper-like material it is possible to control the hydrophobic properties of the material.

The hydrophobicity of a fibrous paper-like material is determined in accordance with the test described in TAPPI/ANSI T 558 om-15, and the result, which is presented as a contact angle measured in "degrees", can range from near zero degrees to near 180 degrees. In more detail, according to the test described in TAPPI/ANSI T 558 om-15, a drop of a specified volume of water is applied to a surface of the fibrous paper-like material using specified deposition parameters. Images of the drop in contact with the sheet are captured by a video camera at specified time intervals following deposition. The water contact angle, that is, the angle formed by the sheet of fibrous paper-like material and the tangent to the surface of a water drop in contact with the sheet, is determined by image analysis techniques on the captured images. The water contact angle at specified times, the rate of change of the contact angle, changes in the drop height and diameter can also be analysed and may provide additional information about the material being tested.

According to the invention, the fibrous paper-like material has a water contact angle greater than 90 degrees. Thus, a sheet of the fibrous paper-like material behaves effectively as an overall hydrophobic material.

Preferably, the fibrous paper-like material has a water contact angle greater than 95 degrees. More preferably, the fibrous paper-like material has a water contact angle greater than 100 degrees.

In addition, or as an alternative, the fibrous paper-like material preferably has a water contact angle of less than 110 degrees. In preferred embodiments, the fibrous paper-like material has a water contact angle from 80 degrees to 120 degrees. More preferably, the fibrous paper-like material has a water contact angle from 95 degrees to 110 degrees.

By contrast, conventional cellulose acetate and paper (cellulose) sheet materials all have water contact angles below about 40 degrees. In other words, they all behave as overall hydrophilic materials.

In aerosol-generating articles in accordance with the invention, biodegradable fibres are used for both the hydrophobic and the hydrophilic portions of the fibres forming the paper-like material. As described briefly above, the biodegradability in an aqueous medium of the fibrous paper-like material is at least 90 percent of the maximum degradation of a cellulose reference item within 56 days of testing.

The aqueous biodegradability properties of the fibrous paper-like material is determined in accordance with the test described in ISO 14851 Determination of the ultimate aerobic biodegradability of plastic materials in an aqueous medium—Method by measuring the oxygen demand in a closed respirometer (2005). The test material is brought into a chemically defined liquid medium, which is essentially free of other organic carbon sources, and spiked with micro-organisms. During the aerobic biodegradation of organic materials in an aqueous medium, oxygen is consumer and carbon is converted into gaseous, mineral carbon in the form of carbon dioxide. Part of the organic material is assimilated for cell growth. A KOH solution is used for trapping the carbon dioxide released, and the pressure drop thus induced is directly related to the consumed oxygen and, accordingly, provided an indirect measurement of the biodegradation of the test material. The amount of biodegradation based on oxygen consumption is expressed as the ratio of the Biochemical Oxygen Demand (BOD, corrected for the control) to the Theoretical Oxygen Demand (ThOD) or Chemical Oxygen Demand (COD) of the test material. The biodegradation based on carbon dioxide production is calculated as the percentage of solid carbon of the test material that has been converted to gaseous, mineral carbon in the form of carbon dioxide.

According to the European standard EN 14987 Plastics—Evaluation of disposability in waste water treatment plants—Test scheme for final acceptance and specification (2006), a material can only be called biodegradable when the percentage of biodegradation is at least 90 percent in total or 90 percent of the maximum degradation of a suitable reference item within 56 days of testing. In practice, the amount of biodegradation determined for the test material is compared with the amount of biodegradation determined for a cellulose reference item having specified characteristics.

At the start of the experiment, reactors are filled with the same amount of mineral medium and a predetermined amount of a source of micro-organisms (inoculum) to obtain a test medium having a specified concentration of suspended solids/litre. The cellulose reference item and the test material(s) are added to the reactors, and the reactors are incubated at controlled ambient room temperature in the dark for at least 28 days. Over the incubation period, oxygen consumption is constantly recorded, whereas the amount of carbon dioxide produced and captured in a KOH solution is determined tritrimetically at regular intervals. The test material can considered to be biodegradable if the condition set out above is met.

Preferably, the fibrous paper-like material has a biodegradability in a soil medium as tested in accordance with IS 17556 (2012) of at least 80 percent of the maximum degradation of a cellulose reference item within 120 days of testing. More preferably, the fibrous paper-like material has a biodegradability in a soil medium as tested in accordance with IS 17556 (2012) of at least 80 percent of the maximum degradation of a cellulose reference item within 90 days of testing. Even more preferably, the fibrous paper-like material has a biodegradability in a soil medium as tested in accordance with IS 17556 (2012) of at least 80 percent of the maximum degradation of a cellulose reference item within 60 days of testing.

The aqueous biodegradability properties of the fibrous paper-like material is determined in accordance with the test described in ISO 17556 Determination of the ultimate aerobic biodegradability in soil by measuring the oxygen demand in a respirometer or the amount of carbon dioxide released (2012). The test material is mixed with soil and incubated in the dark at ambient room temperature. During biodegradation through microbial activity a mixture of gases, mainly carbon dioxide and water, is produced. Carbon dioxide is captured in a KOH solution and periodically determined by titration, which allows one to determine the cumulative carbon dioxide production. The percentage of biodegradation can be calculated as the percentage of solid carbon of the test material, which has been converted to gaseous carbon in the form of carbon dioxide.

In view of fulfilling the biodegradable soil conformity mark of Vingotte, a test material needs to have a percentage of biodegradation that is at least 90 percent in total or 90 percent of the maximum degradation of a suitable reference item after a plateau has been reached for both test material and reference item. In practice, at the end of the test, which lasts 120 days, the amount of biodegradation determined for the test material is compared with the amount of biodegradation determined for a cellulose reference item having specified characteristics. The test material can considered to be biodegradable if the condition set out above is met.

By contrast, conventional cellulose acetate sheet materials have a biodegradation in an aqueous medium that is about 20 to 25 percent of the maximum degradation of the cellulose reference item. Cellulose-based materials commonly used for the manufacture of filters and other components of aerosol-generating materials, such as paper wrapper and tipping paper, on the other hand, commonly may have a biodegradation in an aqueous medium that is 90 percent or more of the maximum degradation of the reference item.

By adjusting the ratio of hydrophilic fibres to hydrophobic fibres in the fibrous paper-like material, it is also advantageously possible to control other properties of the sheet. In general, the presence of hydrophilic fibres is desirable in that it helps form a sheet of the fibrous material in a paper making process.

Preferably, the water absorbency of the fibrous paper material as measured in accordance with TAPPI T 432 cm-09 is at least 180 seconds.

The water absorbency of a bibulous substrate, such as the fibrous paper-like material of filters in accordance with the present invention, is determined in accordance with the test described in TAPPI T 432 cm-09. This test procedure determines the time required for an un-sized and absorbent paper-like material to completely absorb a specified quantity of water. To this purpose, ten samples of the fibrous paper-like material, each approximately 100×100 millimetres are conditioned and tested under controlled atmosphere. The test specimens are placed on a horizontal support and a predetermined amount of distilled or deionised water is allowed to flow onto a specimen for a given period of time. A timer is started as soon as the water contacts the specimen and the time is measured that water needs to be completely absorbed, as indicated visually by the disappearance of the glossy or shiny area from the wet spot. The test is repeated on all of the ten specimens, and the average absorption time in seconds is taken as the water absorbency of the test material.

By contrast, 100 percent cellulose paper has a water absorbency as measured in accordance with TAPPI T 432 cm-09 of 2 seconds or less. Cellulose acetate of the type conventionally used in filters for aerosol-generating articles typically has a water absorbency as measured in accordance with TAPPI T 432 cm-09 of 180 seconds or more. The fibrous paper-like material may comprise from about 10 percent to about 90 percent, based on dry weight, of the hydrophilic fibres and from about 90 percent to about 10 percent, based on dry weight, of the hydrophobic fibres. The hydrophilic fibres and the hydrophobic fibres, when taken as a whole, may represent at least 50 percent, based on the dry weight, of the fibrous paper-like material.

Preferably, the fibrous paper-like material comprises at least 40 percent by weight hydrophobic fibres, based on dry weight, with the remainder being hydrophilic fibres. More preferably, the fibrous paper-like material comprises at least 45 percent by weight hydrophobic fibres, based on dry weight. Even more preferably, fibrous paper-like material comprises at least 50 percent by weight hydrophobic fibres, based on dry weight.

The ratio of hydrophobic and hydrophilic fibres in the fibrous paper-like material can be adjusted to control the hydrophobicity of the sheet or sheets from which the filter is formed. Preferably, the ratio of hydrophobic fibres to hydrophilic fibres in the filter is between about 2:3 and 3:2. In particularly preferred embodiments, the ratio of hydrophobic fibres to hydrophilic fibres in the filter is about 1:1, with about 50 percent hydrophobic fibres and 50 percent hydrophilic fibres.

The hydrophilic fibres preferably comprise cellulose fibres. More preferably, the hydrophilic fibres consist of cellulose fibres. Suitable alternative hydrophilic fibres include cotton, wool, hydrophilic viscose. Further suitable alternative hydrophilic fibres will be known to the skilled person. By way of example, hardwoods (eucalyptus, birch, beech), softwoods (pine, fir) and non-tree (bamboo) sources can be used. Wood chips may be processed into pulp grade sheets using a chemical method and bleaching. Fibres may then be formed by processing and dissolving the pulp sheets into dope, and by spinning the dope into fibres. The output of one such process may be in the form of staple fibres (cut and baled) or in the form of a filament yarn.

In some embodiments, the hydrophilic fibres comprise refined cellulose fibres. The refined cellulose fibres may typically have a Shopper-Riegler degree (SR degree) from 9 degrees SR to 90 degrees SR, preferably from 10 degrees SR to 40 degrees SR, more preferably from 15 degrees SR to 25 degrees SR. Refined cellulose fibres having a SR degree in the ranges set out above may advantageously help impart a sheet of the fibrous paper-like material with an improved tensile strength. The SR degree is measured in accordance with ISO 5267-1 (July 2000).

Typically the diameter of the hydrophobic fibres is from 0.015 millimetres to 0.045 millimetres, preferably from 0.02 millimetres to 0.04 millimetres.

Typically, the length of the hydrophilic fibres is less than 20 millimetres, preferably from 1 millimetre to 12 millimetres, even more preferably from 2 millimetres to 5 millimetres. Fibres having a length within these ranges advantageously make manufacturing a sheet of the fibrous paper-like material easier.

The hydrophobic fibres preferably comprise hydrophobic viscose fibres. More preferably, the hydrophobic fibres consist of hydrophobic viscose fibres. Suitable alternative hydrophobic fibres will be known to the skilled person and may include polyester fibres and acrylic fibres.

In a particularly preferred embodiment, the fibrous paper-like material is formed from a mixture consisting of 50 percent cellulose fibres and 50 percent hydrophobic viscose fibres.

Preferably, the hydrophobic fibres have a titer of 0.5 dtex to 40 dtex. More preferably, the hydrophobic fibres have a titer of 1 dtex to 6 dtex. Even more preferably, the hydrophobic fibres have a titer of 1.7 dtex to 3.3 dtex. In addition, or as an alternative, the hydrophobic fibres preferably have a titer of less than about 5 dtex. More preferably, the hydrophobic fibres have a titer of less than about 3 dtex.

Typically, the length of the hydrophobic fibres is less than 20 millimetres, preferably from 1 millimetre to 12 millimetres, even more preferably from 2 millimetres to 5 millimetres. Fibres having a length within these ranges advantageously make manufacturing a sheet of the fibrous paper-like material easier.

The fibrous paper-like material may have a basis weight from about 15 grams per square metre to about 60 grams per square metre. In preferred embodiments, the fibrous paper-like material has a basis weight of at least about 20 grams per square metre. Even more preferably, the fibrous paper-like material has a basis weight of at least 25 grams per square metre. In addition, or as an alternative, the fibrous paper-like material preferably has a basis weight of less than about 50 grams per square metre. More preferably, the fibrous paper-like material has a basis weight of less than 40 grams per square metre. In particularly preferred embodiments, a sheet of the fibrous paper-like material has a basis weight from about 20 grams per square metre to about 50 grams per square metre, more preferably from about 25 grams per square metre to about 40 grams per square metre.

A sheet of the fibrous paper-like material may have a thickness from about 0.025 millimetres to about 0.2 millimetres. In preferred embodiments, the sheet of the fibrous paper-like material has a thickness of at least about 0.05 millimetres, more preferably at least 0.07 millimetres. In addition, or as an alternative, the sheet of the fibrous paper-like material preferably has a thickness of less than 0.175 millimetres, more preferably less than about 0.16 millimetres. In particularly preferred embodiments, a sheet of the fibrous paper-like material has a thickness from about 0.05 millimetres to about 0.175 millimetres, more preferably from about 0.07 millimetres to about 0.16 millimetres.

A sheet of the fibrous paper-like material may have a porosity from about 1000 CORESTA units to about 50000 CORESTA units. In preferred embodiments, the sheet of the fibrous paper-like material has a porosity of at least about 5000 CORESTA units, more preferably at least 10000 CORESTA units. In addition, or as an alternative, the sheet of the fibrous paper-like material preferably has a porosity of less than 40000 CORESTA units, more preferably less than 35000 CORESTA units. In particularly preferred embodiments, the sheet of the fibrous paper-like material preferably has a porosity from about 5000 CORESTA units to about 40000 CORESTA units, more preferably from about 10000 CORESTA units to about 35000 CORESTA units. The porosity of the sheet is measured in accordance with IS 2965:2009.

A sheet of the fibrous paper-like material may typically have a tensile strength MD (in the Machine Direction) of at least about 1500 cN/30 millimetres. Preferably, the sheet of the fibrous paper-like material has a tensile strength MD of at least about 2000 cN/30 millimetres, more preferably at least about 2510 cN/30 millimetres. In addition, or as an alternative, the sheet of the fibrous paper-like material preferably has a tensile strength MD of less than about 3500 cN/30 millimetres, more preferably less than about 3200 cN/30 millimetres. In particularly preferred embodiments, the sheet of the fibrous paper-like material has a tensile strength MD from about 2000 cN/30 millimetres to about 3500 cN/30 millimetres, more preferably from about 2510 cN/30 millimetres to about 3200 cN/30 millimetres.

A sheet of the fibrous paper-like material may typically have a tensile strength CD (in the Cross-machine Direction) of at least about 100 cN/30 millimetres. Preferably, the sheet of the fibrous paper-like material has a tensile strength CD of at least about 500 cN/30 millimetres, more preferably at least about 900 cN/30 millimetres. In addition, or as an alternative, the sheet of the fibrous paper-like material preferably has a tensile strength CD of less than about 2000 cN/30 millimetres, more preferably less than about 1750 cN/30 millimetres. In particularly preferred embodiments, the sheet of the fibrous paper-like material has a tensile strength CD from about 500 cN/30 millimetres to about 2000 cN/30 millimetres, more preferably from about 900 cN/30 millimetres to about 1750 cN/30 millimetres.

The tensile strength is measured in accordance with ISO 1924-2 (December 2008), except for: the speed, which is 10 millimetres/minute (in MD) and 30 millimetres/minute (in CD), instead of 20 millimetres/minute; the width of the tested sample, which is 30 millimetres instead of 15 millimetres.

In some embodiments, the fibrous paper-like material comprises one additive selected from a sizing agent, a humectant, a selective filtration agent and mixtures thereof.

The sizing agent may be one of an alkyl ketene dimer, an alkenyl ketene dimer, an alkenyl succinic anhydride, rosin and mixtures thereof. The sizing agent may advantageously improve the hydrophobicity, the surface strength and printability of a sheet of the fibrous paper-like material.

The humectant may be a polyether, such as a polyalkylene glycol having an average molecular weight of at least about 500 grams/mol. Other examples of suitable humectants include monopropylene glycol, sorbitol, glycerin, triacetin, and mixtures thereof.

The selective filtration agent may be an amino acid or an amino acid salt, in particular a basic amino acid or basic amino acid salt, or a combination thereof.

Typically, the fibrous paper-like material comprises less than 45 percent by dry weight of the additive. Preferably, the fibrous paper-like material comprises less than about 30 percent by weight of the additive. The additives may advantageously accelerate the biodegradation kinetics of the fibrous paper-like material.

In some embodiments, the fibrous paper-like material comprises a binding agent. The binding agent may be selected from the group consisting of polyvinyl alcohol (PVOH), ethylene vinyl alcohol (EVOH), polyvinyl acetate (PVA), polyethylene, polypropylene, polyester, cellulose acetate, cellulose ester, alkyl succinic anhydride, a rosin, an acrylic copolymer such as a styrene acrylic copolymer, a modified starch, an hydrocolloid such as a gelatin, and mixtures thereof.

In an embodiment, the binding agent may be in the form of a fibre. One such binding agent may be selected from the group consisting of polyvinyl alcohol (PVOH) fibre, polyvinyl acetate (PVA) fibre, polyethylene fibre, polypropylene fibre, polyester fibre, cellulose acetate fibre, nylon, cellulose ester fibre and mixtures thereof.

Typically, the fibrous paper-like material may comprise 20 percent by dry weight or less of the binding agent. In preferred embodiments, the fibrous paper-like material comprises from about 5 percent by dry weight to 15 percent by dry weight of the binding agent.

It has been found that embodiments of the fibrous paper-like material of the present invention comprising a binding agent display increased tensile strength (both in MD and CD). This advantageously further contributes to improving the machinability of the fibrous paper-like material of the present invention. In addition, the fibrous paper-like material of the present invention generally has a smoother finish, which may lead to a reduction of friction.

In a particularly preferred embodiment, a sheet of paper-like fibrous material comprises from 37 percent by dry weight to 39 percent by dry weight of refined cellulose fibres as the hydrophilic fibres, from 37 percent by dry weight to 39 percent by dry weight of hydrophobic viscose fibres, from 7 percent by dry weight to 8 percent by dry weight of a sizing agent and from 15 percent by dry weight to 18 percent by dry weight of a humectant.

In another particularly preferred embodiment, a sheet of paper-like fibrous material comprises from 27 percent by dry weight to 29 percent by dry weight of refined cellulose fibres as the hydrophilic fibres, from 27 percent by dry weight to 29 percent by dry weight of hydrophobic viscose fibres, from 15 percent by dry weight to 25 percent by dry weight of a binding agent, from 7 percent by dry weight to 8 percent by dry weight of a sizing agent and from 15 percent by dry weight to 18 percent by dry weight of a humectant A sheet of the fibrous paper-like material for use in the filter of an aerosol-generating article in accordance with the invention can be produced from a combination of hydrophobic fibres and hydrophilic fibres as set out above using conventional paper making processes and equipment. Accordingly, the fibres can be brought into an aqueous suspension or slurry that can be converted into a paper-like sheet on, for example, a Fourdrinier paper machine. Wet sheets of a fibrous paper-like material for use in this invention can be made on inclined wire, flat wire or cylinder machines or by other papermaking means. Use of an inclined wire machine is preferred. The wet sheet thus formed is then dried to obtain the sheet of fibrous paper-like material.

The drying operation may typically carried out at a temperature from about 60 degrees Celsius to about 175 degrees Celsius, preferably from about 70 degrees Celsius to about 150 degrees Celsius, even more preferably from about 80 degrees Celsius to 130 degrees Celsius.

If the sheet of paper-like fibrous material contains one or more of the additives referred to above, the additives may be added to the aqueous suspension or slurry in the same step during which the hydrophobic fibres and the hydrophilic fibres are mixed with water or after the suspension or slurry containing the fibres has been formed. As an alternative, the one or more additives may be added to the wet paper-like sheet as formed, prior to the drying operation. In a further alternative process, the one or more additives may be added to the paper-like sheet after the drying operation has been completed.

Typically, the sizing agent is added to the wet paper using bath sizing, using a size press, through spraying, through the use of a smoothing press, through the use of a gate roll size press, using calendar sizing, through blade coating, or the like. When using a size press to apply the sizing agent, the newly formed wet paper can be passed through rollers that press the sizing agent into the paper sheet and optionally remove excess additive or size.

There may be certain advantages to applying the sizing agent using a size press. For instance, the sizing agent can make the wet paper more hydrophobic or can improve surface strength or water resistance or both. Thus, the wet paper may be more easily dewatered.

Any suitable technique may be used to apply the humectant to the papers. For instance, the humectant may be applied by size press, spraying, knife coating, Meyer rod coating, dusting, transfer roll coater or through any suitable printing process. Suitable printing processes include flexographic printing, gravure printing, and the like. In an embodiment, the humectant may cover substantially 100 percent of the surface area of one side or of both sides of the sheet of paper-like fibrous material.

In an embodiment, the humectant can be printed on one or both sides of the sheet of paper-like fibrous material. Thus, the humectant is used to coat the papers while still retaining of the benefits. By way of example, the humectant may be applied to one surface of the sheet of paper-like fibrous material so as to cover from 10 percent to 100 percent of the surface area of the sheet of paper-like fibrous material, preferably from 20 percent to 90 percent of the surface area of the sheet of paper-like fibrous material, more preferably from 40 percent to 60 percent of the sheet of paper-like fibrous material. In an alternative embodiment, or in addition, the humectant can be distributed in the thickness of the sheet of paper-like fibrous material with a view to increasing a reactive area.

The selective filtration agent may for example be combined and applied simultaneously with the sizing agent or the humectant.

As will be explained in more detail below, the drying operation may be followed by a further step of shaping the dried sheet by one or more of gathering, crimping, embossing, corrugating. Preferably, the segment of filtration material is formed of one or more gathered sheets of the fibrous paper-like material. More preferably, in the segment of filtration material the one or more gathered sheets of the fibrous paper-like material are circumscribed by a wrapper, such as a conventional (paper) filter plug wrap.

As used herein, the term "gathered" denotes that the sheet of fibrous paper-like material is convoluted, folded, or otherwise compressed or constricted substantially transversely to a cylindrical axis of the filter segment.

The gathered sheet of fibrous paper-like material preferably extends along substantially the entire length of the filter segment and across substantially the entire transverse cross-sectional area of the filter segment.

Filter segments formed of one or more gathered sheets of a fibrous paper-like material in accordance with the invention may advantageously exhibit significantly low weight standard deviations. The weight of a filter segment formed of one or more gathered sheets and having a particular length is determined by the density, width and thickness of the sheet of fibrous paper-like material that is gathered to form the filter segment. The weight of such filter segments can thus be regulated by controlling the density and dimensions of the sheet of fibrous paper-like material. This advantageously reduces inconsistencies in weight between filter segments according to the invention of the same dimensions, and so results in lower rejection rate of filter segments whose weight falls outside of a selected acceptance range.

Further, filter segments formed of one or more gathered sheets of a fibrous paper-like material in accordance with the invention homogenised tobacco material may advantageously exhibit more uniform densities than conventional filter segments.

In preferred embodiments, filter segments according to the invention are formed of one or more gathered textured sheets of the fibrous paper-like material circumscribed by a wrapper. Use of a textured sheet of fibrous paper-like material may advantageously facilitate gathering of the sheet of fibrous paper-like material to form a filter segment according to the invention.

As used herein, the term "textured sheet" denotes a sheet that has been crimped, embossed, debossed, perforated or otherwise deformed. Textured sheets of fibrous paper-like material for use in the invention may comprise a plurality of spaced-apart indentations, protrusions, perforations or a combination thereof. In the context of the present invention, the term "crimped sheet" is intended to be synonymous with the term "creped sheet" and denotes a sheet having a plurality of substantially parallel ridges or corrugations.

Preferably, the crimped sheet of fibrous paper-like material has a plurality of ridges or corrugations substantially parallel to the cylindrical axis of the filter segment and the aerosol-generating article according to the invention. This advantageously facilitates gathering of the crimped sheet of fibrous paper-like material to form the filter segment. However, it will be appreciated that crimped sheets of fibrous paper-like material for use in the invention may alternatively or in addition have a plurality of substantially parallel ridges or corrugations disposed at an acute or obtuse angle to the cylindrical axis of the filter segment.

In certain embodiments, sheets of fibrous paper-like material for use in the invention may be substantially evenly textured over substantially their entire surface. For example, crimped sheets of fibrous paper-like material for use in the invention may comprise a plurality of substantially parallel ridges or corrugations that are substantially evenly spaced-apart across the width of the sheet.

As an alternative to forming the segment of filtration material by gathering one or more sheets of fibrous paper-like material as described above, a filter segment for use in an aerosol-generating article in accordance with the invention may be formed from shreds or strands obtained by performing a cutting operation or a shredding operation on a sheet of the fibrous paper-like material. By way of example, a sheet of the fibrous paper-like material comprising a combination of fibres as set out above may be cut into shreds or strands having a predetermined width. The shreds or strands may additionally be cut to a predetermined length, such as for example from about 10 millimetres to 15 millimetres. The shreds or strands may be circumscribed by a wrapper, such as a (paper) filter plug wrap, to form a segment of filtration material in a process similar to the process for forming a rod of cut filler for a conventional cigarette.

A filter for use in an aerosol-generating article in accordance with the invention may typically have a filtration efficiency from about 45 percent to about 60 percent. Preferably, a filter for use in an aerosol-generating article in accordance with the invention has a filtration efficiency from about 50 percent to about 55 percent. The filtration efficiency is measured in accordance with ISO 4387: 2000-04-01 (Third Edition)—Cigarettes—Determination of total and nicotine-free dry particulate matter using a routine analytical smoking machine. A filter for use in an aerosol-generating article in accordance with the invention may include one or more filter elements or segments formed of the fibrous paper-like material described above.

In addition, or as an alternative, a filter element for use in an aerosol-generating article in accordance with the invention may include one or more segments formed of alternative filtration materials.

In some embodiments, the aerosol-generating substrate may be in the form of a rod of randomly oriented shreds, strands or strips of tobacco material, circumscribed by a paper wrapper, as in conventional cigarettes. The filter segment or element may be attached to the rod by means of tipping paper.

In other embodiments, the aerosol-generating substrate may be in the form of a gathered sheet of homogenised tobacco material. Rods of this type have been described in international patent application WO-A-2012/164009 and are particularly suitable for heated aerosol-generating articles. Another alternative is known from international patent application WO-A-2011/101164, which discloses rods for heated aerosol-generating articles formed from strands of homogenised tobacco material, which may be formed by casting, rolling, calendering or extruding a mixture comprising particulate tobacco and at least one aerosol former to form a sheet of homogenised tobacco material.

Aerosol-generating articles according to the invention preferably comprise one or more elements in addition to the rod of aerosol-generating substrate and the filter, wherein the rod, the filter and the one or more elements are assembled within a substrate wrapper. For example, aerosol-generating articles according to the invention may further comprise at least one of: a mouthpiece, an aerosol-cooling element and a support element such as a hollow acetate tube. For example, in one preferred embodiment, an aerosol-generating article comprises, in linear sequential arrangement, a rod of aerosol-generating substrate as described above, a support element located immediately downstream of the aerosol-generating substrate, an aerosol-cooling element located downstream of the support element, and an outer wrapper circumscribing the rod, the support element and the aerosol-cooling element.

Figure 2:
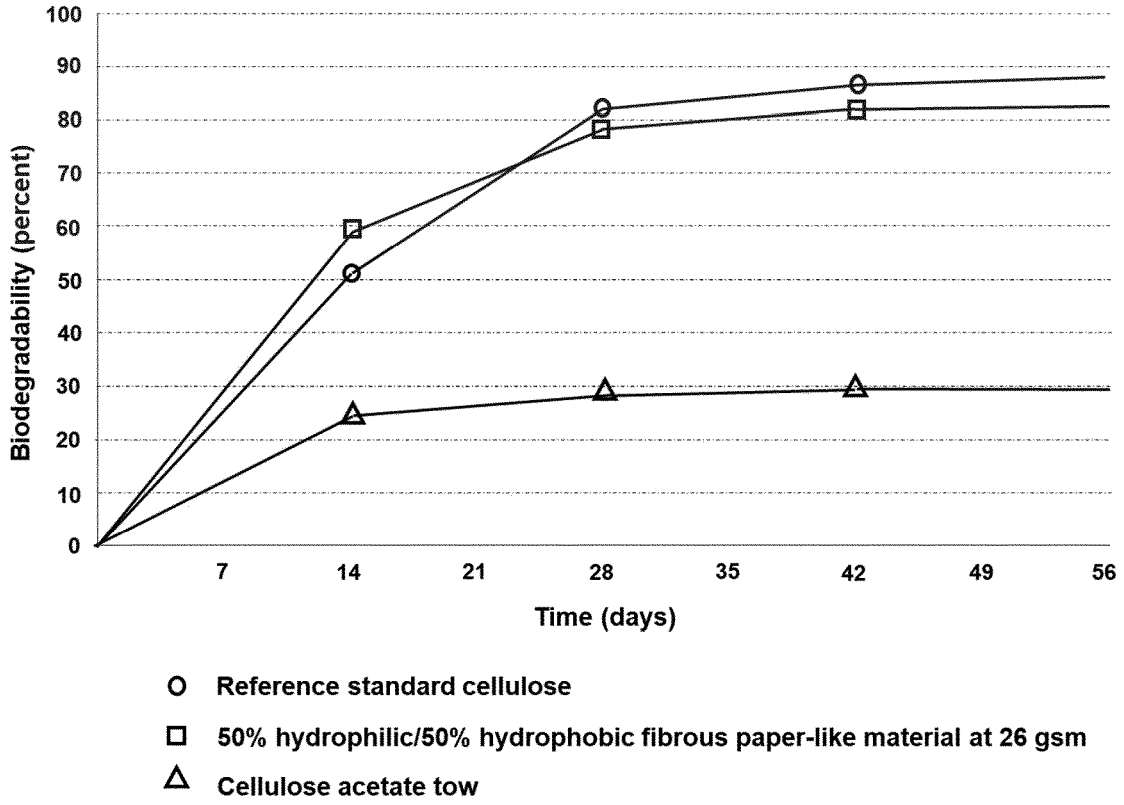

The invention will now be further described with reference to the following Examples and the accompanying Figures, wherein:

FIG. 1 is a schematic side cross-sectional view of an aerosol-generating article in accordance with the invention; and FIG. 2 is a graph showing the results of biodegradation tests carried out on samples of the fibrous paper-like material for use in an aerosol-generating article in accordance with the invention, as explained in the Examples below.

An embodiment of an aerosol-generating article 10 in accordance with the invention is illustrated in FIG. 1. The aerosol-generating article 10 comprises a rod 12 of an aerosol-generating substrate and a mouthpiece filter 14 in axial alignment with the aerosol-generating substrate. The filter 14 is arranged downstream from the aerosol-generating substrate 12.

The filter 14 comprises a segment of filtration material formed of one or more sheets of a fibrous paper-like material in accordance with the invention prepared as will be described in more detail below. In more detail, in the segment of filtration material the one or more sheets of fibrous paper-like material are gathered and extend along substantially the entire length of the segment and across substantially the entire transverse cross-sectional area of the segment.

In addition, the aerosol-generating article 10 comprises a hollow cellulose acetate tube 16 and a spacer element 18 arranged between the rod 12 and the filter 14, such that all four elements are arranged sequentially and in coaxial alignment. All four elements are circumscribed by a same wrapper 20 to form the aerosol-generating article.

The rod of aerosol-generating substrate 12 has a length of approximately 12 millimetres and a diameter of approximately 7 millimetres. The rod 12 is cylindrical in shape and has a substantially circular cross-section. The filter 14 is substantially cylindrical in shape and has a substantially circular cross-section, has a length of approximately 7 millimetres and a diameter of approximately 7 millimetres.

EXAMPLE 1

Several examples of the fibrous paper-like material of the invention were made at laboratory scale and tested by industry standard techniques. The hydrophobic fibres were DANUFIL OLEA® viscose fibres manufactured by Kelheim Fibres GmbH. These fibres have a titre of 1.7 dtex (1.53 den) to 3.3 dtex (2.97 den), and a length of 5 millimetres. Various types of hydrophilic fibres were used, such as bleached or unbleached softwood fibres, or bleached cellulose fibres all having a SR degree of 15 degrees SR. To make the fibrous paper-like material, both types of fibres were mixed with water to obtain a slurry. The aqueous slurry thus formed was then deposited onto a porous forming surface of an inclined wire paper machine to form a wet paper. The wet paper was then dried at a temperature between 80 degrees Celsius and 100 degrees Celsius.

The composition and characteristics of five samples are shown below.

| | Sample 1 | Sample 2 | Sample 3 | Sample 4 | Sample 5 |
|---|---|---|---|---|---|
| Hydrophobic fibres (percent by dry weight, dtex) | 50 percent, 1.7 | 60 percent, 3.3 | 50 percent, 1.7 | 50 percent, 1.7 | 49.9 percent, 1.7 |
| Hydrophilic fibres (percent by dry weight, type) | 50 percent Bleached softwood fibres | 40 percent Bleached softwood fibres | 50 percent Unbleached softwood fibres | 50 percent Bleached softwood fibres | 49.9 percent Bleached cellulose fibres |
| Basis weight (grams per square metre) | 36 | 37 | 37 | 26 | 26 |
| Porosity (CORESTA) | 18700 | 21500 | 11000 | 24600 | 16900 |
| Tensile strength MD (cN/30 millimetres) | 3110 | 2690 | 3200 | 2500 | 2830 |
| Tensile strength CD (cN/30 millimetres) | 1600 | 1075 | 1200 | 990 | 1120 |
| Capillarity Rise (millimetres/10 minutes) | 0 | 0 | 0 | 0 | 0 |
| Water drop (sec) TAPPPI-T432 | >180 | >180 | >180 | >180 | >180 |
| Water contact angle (degrees) | 94 | 116 | 103 | 84 | Not measured |

Sample 5 contained, in addition, 0.15 percent by dry weight of alkyl ketene dimer, a sizing agent.

The Capillarity Rise of the paper sheet is measured in accordance with ISO 8787:1986.

The Water drop value corresponds to the time necessary for a drop of water to be absorbed by a sheet of the fibrous paper-like material as measured by TAPPI T432 of 1964.

For comparison, a fibrous paper-like material containing 100 percent by weight unrefined softwood fibres was similarly made and tested. This control paper exhibited a Capillarity Rise value of 96 millimetres/10 minutes and a water drop value of less than 2 seconds.

EXAMPLE 2

Filter elements made of fibrous paper-like material were subjected to an aqueous biodegradation test. The standard methodology described in ISO 14851—Determination of the ultimate aerobic biodegradability of plastic materials in an aqueous medium was followed. The test determines the biodegradation of a test item under laboratory conditions caused by a conditioned sludge. In more detail, the test material is brought into a chemically defined liquid medium, essentially free of other organic carbon sources, and spiked with micro-organisms. During the aerobic biodegradation of organic materials in an aqueous medium, oxygen is consumed and carbon is converted to carbon dioxide. At regular intervals the amount of $CO_2$ produced is determined by titration of the KOH solution which absorbs $CO_2$. The biodegradation based on $CO_2$ production is calculated as the percentage of solid carbon of the test compound which has been converted to gaseous, mineral C in the form of $CO_2$.

Two test items and one reference standard were tested. The cellulose reference standard is microcrystalline cellulose powder which is suitable for thin layer chromatography (Avicel, FMC). Test item 1 was a smoked cigarette butt comprising tipping paper and a 26 gsm fibrous paper-like filtration material of the invention made of 50 percent by dry weight bleached softwood fibres and 50 percent by dry weight Danufil Olea viscose fibres at 1.7 dtex (1.53 den) and 5 millimetres length. The contact angle of this material in item 1 was found to be greater than 95 degrees. Test item 2 was a smoked cigarette butt comprising the same type of tipping paper and conventional non-woven cellulose acetate as the filtration material. The contact angle of the cellulose acetate in item 2 was 90 degrees. Both items 1 and 2 had similar length (27 mm) and similar diameter (7.7 mm). Both were cut into small pieces of less than 2 millimetres in size at the start of the test.

The test was performed in triplicate. At the start of the test, each one of 12 reactors was filled with the same amount of mineral medium and inoculum to obtain a test medium with a concentration of approximately 30 milligrams suspended solids/litre. The reference and test items were added directly to the reactors. One set of 3 blank controls were also included. The source of micro-organisms (inoculum) was a mixture of activated sludge, obtained from different wastewater treatment plants. The reactors were stirred and incubated at a constant temperature (21 degrees Celsius ±1 degree Celsius) in the dark for a period of 56 days.

After 14, 28, 42 and 56 days the biodegradation was determined by measuring the amount of $CO_2$ that had been captured in the KOH solution during the test. See FIG. 2.

Table 1 shows the results after 56 days. $ThCO_2$ (=theoretical $CO_2$ production based on the % organic carbon and input of the sample), net $CO_2$ production and biodegradation percentage of reference and test items at the end of the test.

| Experimental series | $ThCO_2$ (mg) | $NetCO_2$ (mg) | Average biodegradation (percent) | Standard deviation | Relative biodegradation (percent) |
|---|---|---|---|---|---|
| Cellulose reference standard | 38.3 | 33.6 | 87.8 | 2.8 | 100 |
| Items 1 26gsm fibrous paper-like material | 39.3 | 32.5 | 82.7 | 3.0 | 94.2 |
| Items 2 Cellulose acetate tow | 41.3 | 12.3 | 29.8 | 1.5 | 33.9 |

The biodegradation pattern of item 2 comprising the fibrous paper-like material was similar to that of the reference standard cellulose. After 14 days, a biodegradation of 59.5% was reached. From then on the biodegradation rate started to slow down. After 28 days an absolute biodegradation of 78.0 percent ±3.1 percent was measured. At the end of the test (56 days) a plateau in biodegradation was reached at a level of 82.7 percent ±3.0 percent. On a relative basis, compared to the reference standard, a biodegradation percentage of 94.2 percent was calculated.

In comparison, the biodegradation of cellulose acetate-containing item 1 started almost immediately at a moderate rate, but levelled off from 14 days onwards. After 56 days, an absolute biodegradation of 29.8 percent ±1.5 percent was measured, or 33.9 percent on a relative basis compared to the pure cellulose reference standard.

From these results, it can be concluded that test item 1 comprising the fibrous paper-like material of the invention fulfilled the 90 percent biodegradability requirement within 56 days of testing.

The invention claimed is:

1. An aerosol-generating article comprising:

an aerosol-generating substrate;

a filter in axial alignment with the aerosol-generating substrate, the filter comprising at least one segment of filtration material formed of one or more sheets of a fibrous paper-like material, wherein the fibrous paper-like material comprises a combination of hydrophobic fibres and hydrophilic fibres such that the fibrous paper-like material has a water contact angle as measured in accordance with TAPPI/ANSI T 558 om-15 greater than 90 degrees and wherein the fibrous paper-like material has a biodegradability in aqueous medium as tested in accordance with ISO 14851 (2005) of at least 70 percent of the degradation of a cellulose reference within 56 days of testing, wherein the hydrophobic fibres comprise hydrophobic viscose fibres.

2. The aerosol-generating article according to claim 1 wherein the fibrous paper-like material has a water contact angle as measured in accordance with TAPPI/ANSI T 558 om-15 of between 95 degrees and 105 degrees.

3. The aerosol-generating article according to claim 1 wherein the fibrous paper-like material has a biodegradability in aqueous medium as tested in accordance with ISO 14851 (2005) of at least 90 percent of the degradation of a cellulose reference within 56 days of testing.

4. The aerosol-generating article according to claim 1 wherein the water absorbency of the fibrous paper-like material is greater than 180 seconds.

5. The aerosol-generating article according to claim 1 wherein the hydrophilic fibres and the hydrophobic fibres represent at least 50 percent of weight of the dry matter of the fibrous paper-like material.

6. The aerosol-generating article according to claim 1 wherein the ratio of hydrophobic fibres to hydrophilic fibres is between 2:3 and 3:2, or 2:1 and 1:2.

7. The aerosol-generating article according to claim 6 wherein the ratio of hydrophobic fibres to hydrophilic fibres in the fibrous paper-like material is about 1:1.

8. The aerosol-generating article according to claim 1 wherein the hydrophilic fibres comprise plant fibres, softwood fibres, or cellulose fibres.

9. The aerosol-generating article according to claim 1 wherein the fibrous paper-like material has a basis weight of at least 25 grams per square metre.

10. The aerosol-generating article according to claim 1 wherein the segment of filtration material is formed of one or more gathered sheets of the fibrous paper-like material.

11. The aerosol-generating article according to claim 1 wherein the one or more sheets of the fibrous paper-like material are crimped.

12. The aerosol-generating article according to claim 1 wherein the fibrous paper-like material comprises a binding agent selected from the group consisting of polyvinyl alcohol (PVOH), ethylene vinyl alcohol (EVOH), polyvinyl acetate (PVA), polyethylene, polypropylene, polyester, cellulose acetate, cellulose ester, alkyl succinic anhydride, a rosin, an acrylic copolymer, a modified starch, an hydrocolloid, and mixtures thereof.

13. A filter segment for use in an aerosol-generating article comprising a filtration material circumscribed by a wrapper, the filtration material comprising a sheet of fibrous paper-like material, wherein the fibrous paper-like material comprises a combination of hydrophobic fibres and hydrophilic fibres, wherein the fibrous paper-like material has a water contact angle greater than 90 degrees angle as measured in accordance with TAPPI/ANSI T 558 om-15 and a biodegradability in aqueous medium as tested in accordance with ISO 14851 (2005) of at least 70 percent of the degradation of a cellulose reference within 56 days of testing, wherein the hydrophobic fibres comprise hydrophobic viscose fibres.

* * * * *